US010889017B2

(12) United States Patent
Horton

(10) Patent No.: US 10,889,017 B2
(45) Date of Patent: Jan. 12, 2021

(54) SAFETY RAZOR AND HANDLE THEREFOR

(71) Applicant: Mark E. Horton, Arlington, VA (US)

(72) Inventor: Mark E. Horton, Arlington, VA (US)

( * ) Notice: Subject to any disclaimer, the term of this patent is extended or adjusted under 35 U.S.C. 154(b) by 0 days.

(21) Appl. No.: 15/767,442

(22) PCT Filed: Oct. 24, 2016

(86) PCT No.: PCT/US2016/058435
§ 371 (c)(1),
(2) Date: Apr. 11, 2018

(87) PCT Pub. No.: WO2017/078956
PCT Pub. Date: May 11, 2017

(65) Prior Publication Data

US 2018/0290319 A1 Oct. 11, 2018

Related U.S. Application Data

(60) Provisional application No. 62/250,202, filed on Nov. 3, 2015.

(51) Int. Cl.
*B26B 21/16* (2006.01)
*B26B 21/52* (2006.01)
*B26B 21/56* (2006.01)

(52) U.S. Cl.
CPC ..... *B26B 21/165* (2013.01); *B26B 21/16* (2013.01); *B26B 21/521* (2013.01); *B26B 21/56* (2013.01)

(58) Field of Classification Search
CPC ..... B26B 21/165; B26B 21/16; B26B 21/18; B26B 21/56; B26B 21/565
USPC ..... 30/51, 52, 68
See application file for complete search history.

(56) References Cited

U.S. PATENT DOCUMENTS 816,141 A * 3/1906 Wiesenfeld
1,822,766 A * 9/1931 Duffy ..... B26B 21/12 30/31
1,822,903 A * 9/1931 Parker ..... B26B 21/16 30/72
1,832,834 A * 11/1931 Schumacher ..... B26B 21/18 30/72
2,120,940 A 6/1938 Minassian
2,141,339 A 12/1938 Bauerle
(Continued)

FOREIGN PATENT DOCUMENTS

WO 2007/1165397 A2 10/2007

OTHER PUBLICATIONS

International Application No. PCT/US2016/058435, International Search Report and Written Opinion, dated Jan. 3, 2017.
(Continued)

*Primary Examiner* — Hwei-Siu C Payer
(74) *Attorney, Agent, or Firm* — Winston & Strawn LLP

(57) ABSTRACT

A safety razor that includes a handle; a head on one end of the handle, with the head adapted to hold a razor blade and having a top plate and a bottom plate; a razor blade having first and second portions which each terminate at a blade edge; and a slot configured on first and second portions of the bottom plate, each slot configured and dimensioned for receiving one portion of the razor blade and for holding the blade edge at a predetermined angle with respect to the bottom plate. The most preferred blade edge angle is approximately 30° with respect to the bottom plate.

7 Claims, 3 Drawing Sheets

(56) References Cited

U.S. PATENT DOCUMENTS

| | | | | | |
|---|---|---|---|---|---|
| 2,362,851 | A | | 11/1944 | Przybysz | |
| 2,393,366 | A | * | 1/1946 | Hammond | B26B 21/18 30/73 |
| 2,555,214 | A | | 5/1951 | Wallach et al. | |
| 2,648,363 | A | | 8/1953 | Weber | |
| 2,679,094 | A | | 5/1954 | Nolan | |
| 3,109,237 | A | * | 11/1963 | Girouard | B26B 21/00 30/346.5 |
| 3,488,764 | A | * | 1/1970 | Welsh | B26B 21/06 30/50 |
| 3,593,416 | A | * | 7/1971 | Edson | B26B 21/14 30/50 |
| 3,597,841 | A | * | 8/1971 | Miller | B26B 21/28 30/72 |
| 3,660,893 | A | * | 5/1972 | Welsh | B26B 21/165 30/50 |
| 3,777,396 | A | | 12/1973 | Simonetti | |
| 3,938,250 | A | * | 2/1976 | Perry | B26B 21/22 30/346.57 |
| 4,146,958 | A | | 4/1979 | Chen et al. | |
| 4,389,773 | A | * | 6/1983 | Nissen | B26B 21/22 30/32 |
| 4,459,744 | A | * | 7/1984 | Esnard | B26B 21/14 30/346.5 |
| 4,697,342 | A | | 10/1987 | Ferraro | |
| 5,778,535 | A | | 7/1998 | Ledesma | |
| 6,145,201 | A | * | 11/2000 | Andrews | B26B 21/22 30/34.05 |
| 6,701,619 | B2 | | 3/2004 | Haruyuki | |
| 3,033,023 | A1 | | 10/2011 | Johnson et al. | |
| 9,015,951 | B2 | | 4/2015 | Howell et al. | |
| 9,840,014 | B2 | * | 12/2017 | Gilor | B26B 21/443 |
| 2009/0188112 | A1 | | 7/2009 | Prochaska et al. | |
| 2013/0061481 | A1 | * | 3/2013 | Cooney | B26B 21/521 30/526 |
| 2015/0352737 | A1 | * | 12/2015 | Hickam | B26B 21/521 30/70 |
| 2015/0360375 | A1 | * | 12/2015 | Wertz | B26B 21/28 30/52 |
| 2018/0161999 | A1 | * | 6/2018 | Depaz | B26B 21/18 |
| 2018/0290319 | A1 | * | 10/2018 | Horton | B26B 21/16 |

OTHER PUBLICATIONS

International Application No. PCT/US2016/058435, International Preliminary Report on Patentability, dated Nov. 17, 2017.

* cited by examiner

SAFETY RAZOR AND HANDLE THEREFOR

FIELD OF THE INVENTION

This invention relates to certain new and useful improvements in safety razor construction including a new blade arrangement and handle for holding the same at a particularly useful cutting angle with respect to the user's face or skin.

BACKGROUND

Safety razors generally use a single, double edge safety razor blade which is manually inserted into the blade holder or razor head. The handle of the safety razor is generally perpendicular to the single blade although some compression and bending of the blade can occur when the holder is tightened. The razor is used manually and greatly depends on the ability of the shaver's wrist to hold the blade at the correct angle to cut hairs on the face. Because the natural motion of the wrist is circular, even with the best technique and steady hand, it is often times difficult to judge the exact angle of the blade against the face.

A blade angle of approximately 30° has been shown to be very effective at cutting facial hair but it is difficult for the user to orient the blade of a conventional safety razor at that angle during shaving. Even when the user is able to hold the razor at the proper angle, the user's wrist is in a position which is not entirely stable. Indeed, oftentimes the angle between the blade and the face is not optimal and results in a less effective blade cut, which can cause skin irritation, nicks, and/or deep cuts.

DESCRIPTION OF THE PRIOR ART

Safety razors are limited in design by the actual double edge safety blade itself as well as the space between the plates. For example, in most safety razors, the blade and shaving head are perpendicular to the face and the handle parallel to the face. In many razors, this results in a blade angle which is approximately 85° with the handle parallel to the face. To achieve the optimum 30° blade angle, the user must rotate the razor handle 55° which results in a 30° blade angle but an unstable hand position that can cause painful skin irritation.

The prior art has attempted to provide improvements in this area. U.S. Pat. No. 2,555,214 to Wallach et al. discloses a blade made from glass that is first ground to a sharp angle and then dipped in acid. The blade angle is ground to an angle of 30° to try to achieve the desired optimum angle for shaving, but the holder does not assure that the angle is maintained during shaving. Wallace also teaches away from using steel or other metal blades which, because of their thin construction, can be easily split.

U.S. Pat. No. 2,679,094 to Nolan discloses a blade that is permanently shaped (as opposed to split) to try to achieve a controlled desirable angle, but during use the blade can flex or bend during use to a different angle. It is also incumbent upon the user to hold the blade at that angle when shaving.

U.S. Pat. No. 4,146,958 to Chen et al. discloses blades that are not split and cannot be inserted into a slot. Like Nolan, there is nothing in Chen that prevents the entire blade from bending during use.

US patent application publication no. 2009/0188112 A1 to Prochaska et al. discloses a series of blades in a cartridge which are intended to provide better cutting by the multiple blade surfaces, but the disclosed structure does not permit shaving on either side of the razor head.

U.S. Pat. No. 9,015,951 to Howell et al. also discloses a series of blades in a cartridge that is used to more efficiently cut facial hair.

Despite these disclosures, there still remains a need for a safety razor that provides better and more effective cutting of facial hair and this is now provided by the present invention.

SUMMARY OF THE INVENTION

The present invention provides for improved razors that provide the cutting edges of the blades therein at the optimum cutting angle of 30° while keeping the handle parallel to the users face making it easier to control.

In one embodiment, the razor is a safety or disposable razor that comprises a handle; a head on one end of the handle, said head adapted to hold a razor blade and having a top portion and a bottom portion; and a slot configured on the bottom portion, with the slot configured and dimensioned for receiving a first portion of a razor blade which terminates at a blade edge and for holding the blade edge at a predetermined angle with respect to the bottom portion. The top portion of the head is further configured to hold the blade in the slot to lock the blade in place with the blade edge at the predetermined angle.

A related embodiment is one wherein the head has a second slot which is adapted to hold a second razor blade having a top portion and a bottom portion, with the second razor blade having a first portion which terminates at a blade edge and which is received in the slot for holding the blade edge at a predetermined angle with respect to the bottom portion; wherein the second blade is held in the second slot by the top portion of the head to lock the blade in place with the second blade edge at the predetermined angle.

For the foregoing embodiments, the razor may be made or metal or an engineering plastic and configured as a safety razor. Alternatively, the foregoing embodiments can be made as a disposable razor wherein the top and bottom portions of the head are made of a plastic.

In another embodiment, the razor is a safety razor that includes a handle; a head on one end of the handle, with the head having a top plate and a bottom plate; and a slot that is configured on first and second portions of the bottom plate. Each slot is configured and dimensioned for receiving one portion of a razor blade that has first and second portions which each terminate at a blade edge, with the slots further configured for holding each blade edge at a predetermined angle with respect to the bottom plate. When each blade part is placed in the slot, and the top plate of the head is lowered to come into contact with the bottom plate to lock the blades in place with the blade edges at the predetermined angle. As noted, the preferred angle is approximately 30° with respect to the bottom plate.

Preferably, the head further comprises two structures which move downwardly toward the intersection of the head and the handle; said structures designed to bend each blade portion to hold it in its respective slot. Also, the first and second portions are first and second halves which together would form a conventional double edge safety razor blade.

Another embodiment of the invention is a safety razor comprising a handle; a head on one end of the handle, with the head adapted to hold a conventional safety razor blade and having a top portion which, when lowered, will securely hold the separated conventional safety razor blade; and a slot configured on first and second portions of the bottom plate, each slot configured and dimensioned for receiving one half of the razor blade and for holding the blade edge at a predetermined angle with respect to the bottom plate.

As in the prior embodiment, each slot is preferably configured and dimensioned for holding the blade edge of the blade half at an angle of approximately 30° with respect to the bottom plate. Also, the head typically comprises two structures which move downwardly toward the intersection of the head and the handle; said structures designed to place each blade half into a slot.

The invention is also directed to a product that is a combination comprising any one of the safety razors described herein and a conventional size or longitudinally split razor blade received therein. For some embodiments, two safety razor blade portions are received therein with each blade portion held in its respective slot at the desired angle. In one combination, the safety razor blade portions are first and second halves which together would form a conventional safety razor blade. Alternatively, the combination can comprise a safety razor that receives a conventional safety razor blade therein wherein the head includes a top portion which, when lowered, will securely hold the separated conventional safety razor blade halves into the slots.

Another embodiment of the invention is directed to a method of making a safety razor with one or two fixed blade edges at a predetermined cutting angle, which comprises providing a handle and head for the safety razor; and making a slot on one or each side of a bottom plate of the head, with each slot configured and dimensioned to receive a portion of a razor blade with the blade edge fixed at a predetermined angle. In this method, each slot is configured and dimensioned for holding the blade edge of the blade portion at the preferred optimum angle of approximately 30° with respect to the bottom plate of the head. Also, the head may further include two structures which move downwardly toward the intersection of the head and the handle, with the structures designed to bend each blade half to hold it in its respective slot and form two fixed blade edges at the predetermined angle.

In another embodiment of the method, the head is adapted to hold a conventional safety razor blade and the method further comprises placing a conventional safety razor blade in the head and moving a top portion of the head towards the blade to securely hold the separated conventional safety razor blade into first and second halves and to direct the blade halves their respective slots and form two fixed blade edges at the predetermined angle.

BRIEF DESCRIPTION OF THE DRAWINGS

The nature and various advantages of the present invention will become more apparent upon consideration of the following detailed description, taken in conjunction with the accompanying drawings, in which like reference characters refer to like parts throughout, and in which.

DETAILED DESCRIPTION OF THE INVENTION

The present invention now provides a safety razor design which will cut facial hair at the optimum shaving angle of approximately 30° while keeping the handle parallel to the face instead of rotated 55° away from it. This is generally accomplished by providing a standard safety razor blade that is split down the longitudinal center of the blade into two halves and by providing a novel handle head that is configured to hold the split blades at 30° angle.

In the most preferred embodiments, the invention provides for a single double edge razor blade to be split in two. The blades are then inserted into a slot which holds the blade at an angle of approximately 30° enabling the user to hold the handle parallel to what is being cut instead of the uncomfortable 55° handle position. The invention also provides a razor construction of which the blade is split into and then received in a slot which secures the blade. For either embodiment, the blade portions or halves are held securely in their respective slots. Having secure blade edges allows for effective shaving by permitting the user to shave in a single downward direction while holding the blades under tension, eliminating the blade chatter/flutter of most common safety razors. This is a superior method in that all pressure is directed downward in a straight line reducing accidental horizontal movement and is believed to be the most effective method of using a razor with a blade split by a user.

This configuration also allows minimal blade exposure while enabling the user to control the aggressiveness based on the pressure applied. This configuration is superior to previous safety razors as any pressure applied to current safety razors on the market, will result in severe cuts to the users face.

Figure 1:
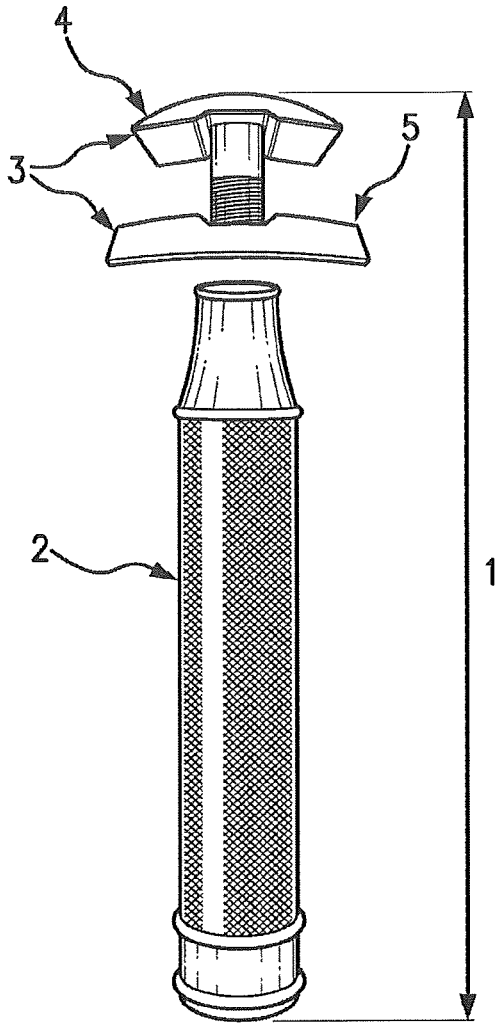
PRIOR ART FIG. 1
FIG. 1 illustrates a conventional safety razor.

FIG. 1 illustrates a conventional safety razor (1) according to the prior art. This razor (1) includes a handle (2), a head (3) with a bottom plate (5) and a top plate (4).

Figure 2:
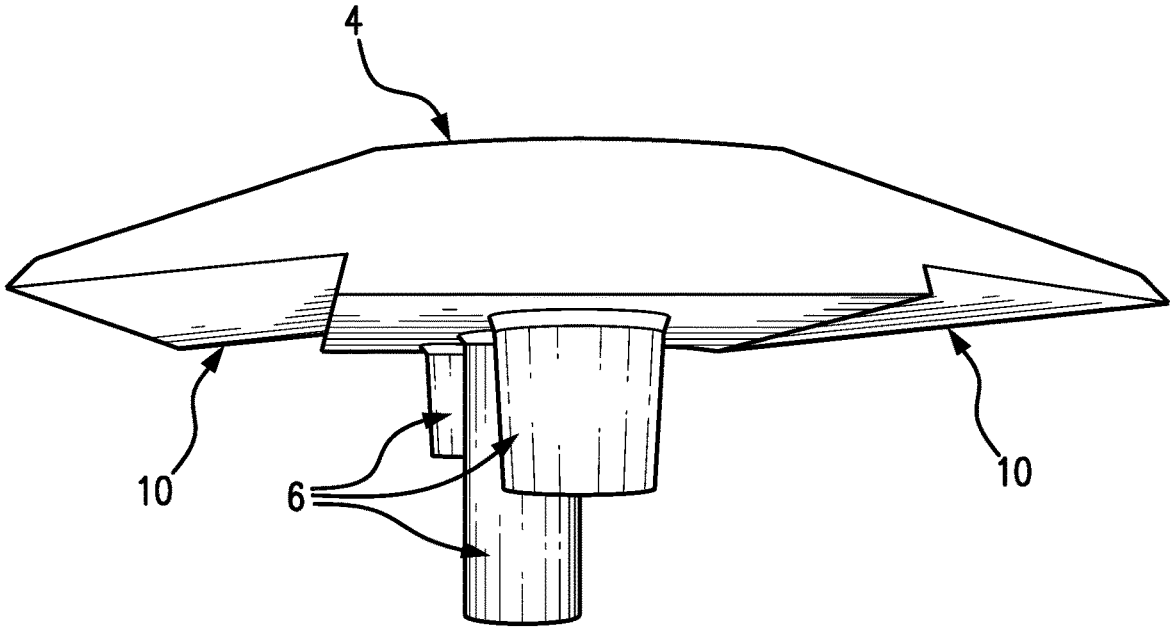
FIG. 2 illustrates the top plate according to the new invention.

FIG. 2 illustrates the top plate (4) according to the invention with standard cylinders (6) that do not hold the razor blades in place like the existing conventional safety razors. Each blade half is inserted into the left and right slots of the bottom plate. With each blade half in their respective slots, the top plate's cylinders (6) are inserted into the holes (8) of the bottom plate. When this occurs, the flaps (10) that extend from the center of the top plate connect with and bend each blade half down to the bottom plate resulting in a secure, precise, taut fit with no blade flutter.

Figure 3:
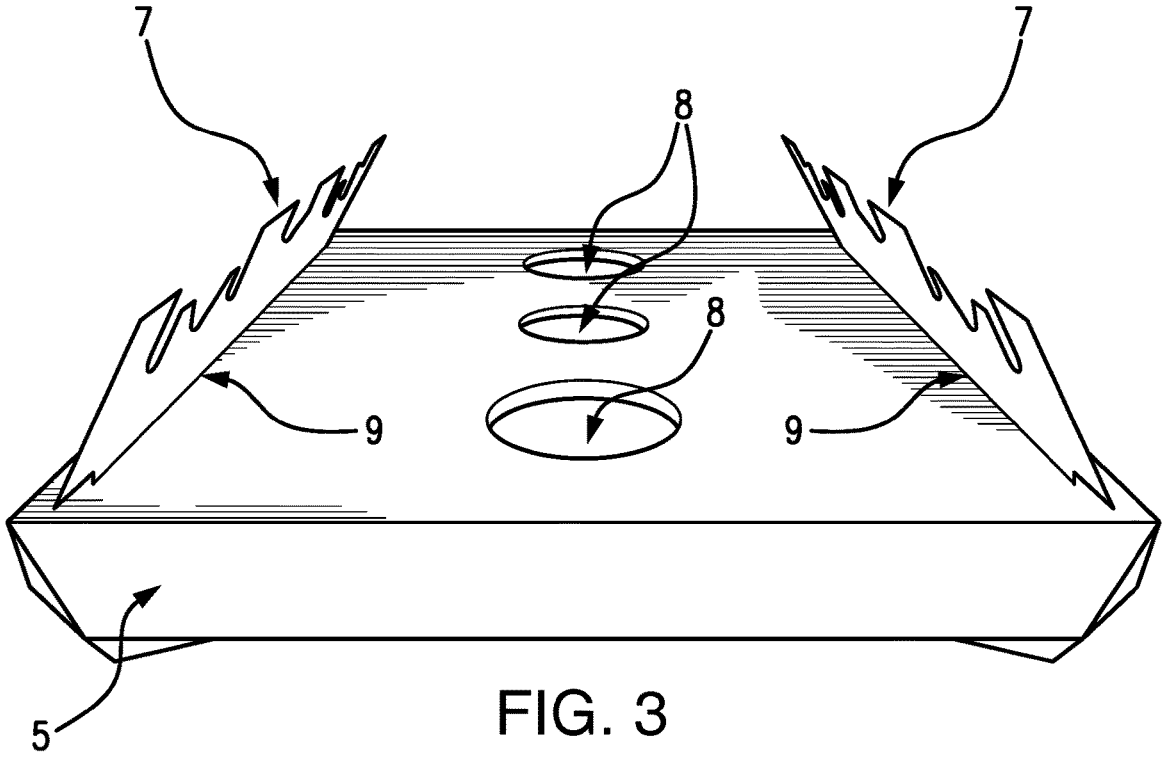
FIG. 3 is a perspective view of a split standard safety razor blade according to the invention.
Figure 4:
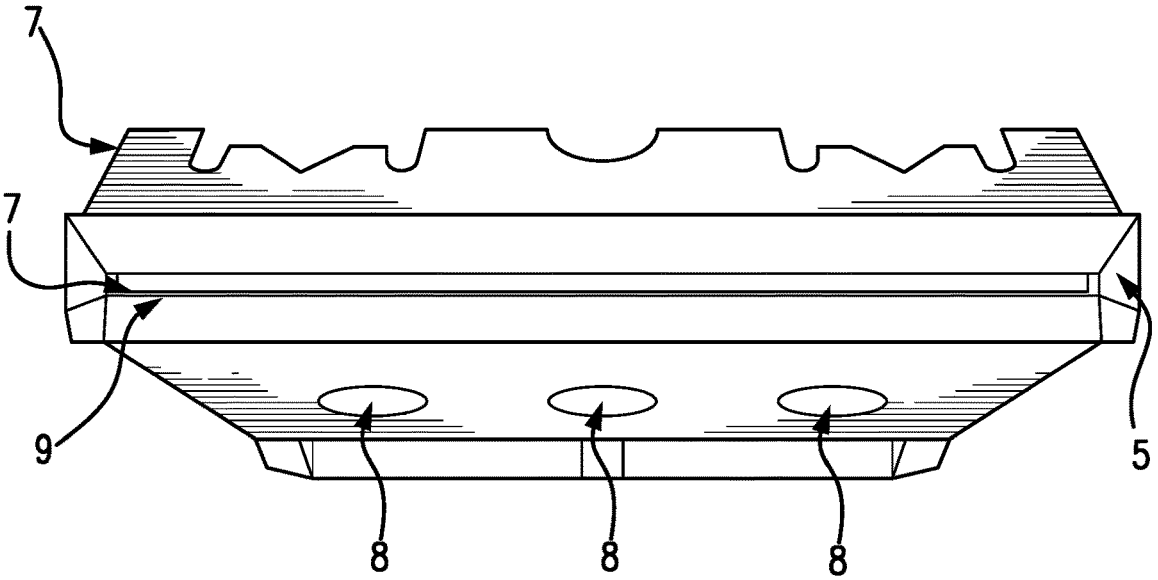
FIG. 4 is an underside view of the split safety razor of FIG. 3.
Figure 5:
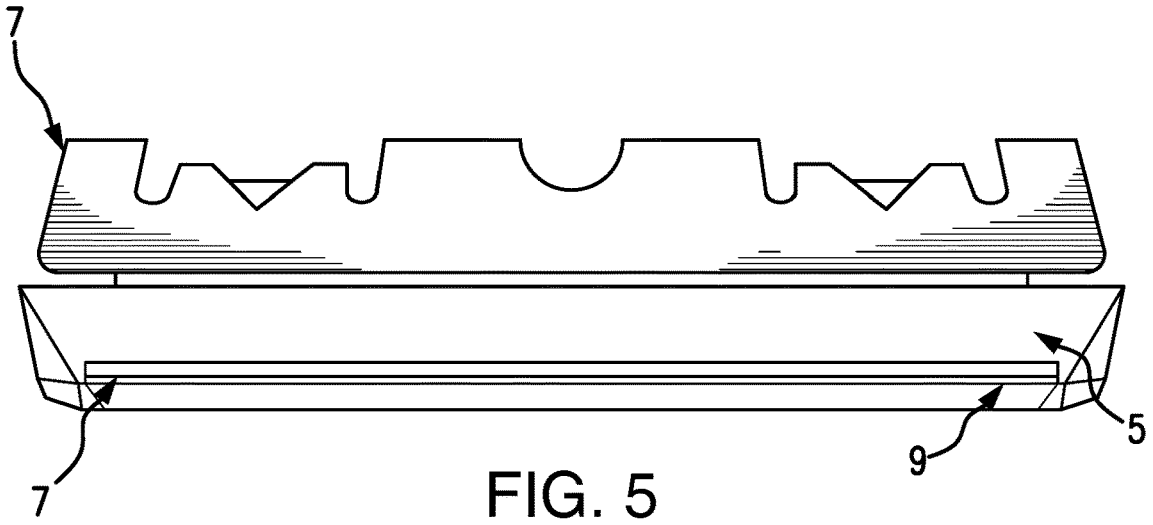
FIG. 5 is a side view of the split safety razor of FIG. 3.
Figure 6:
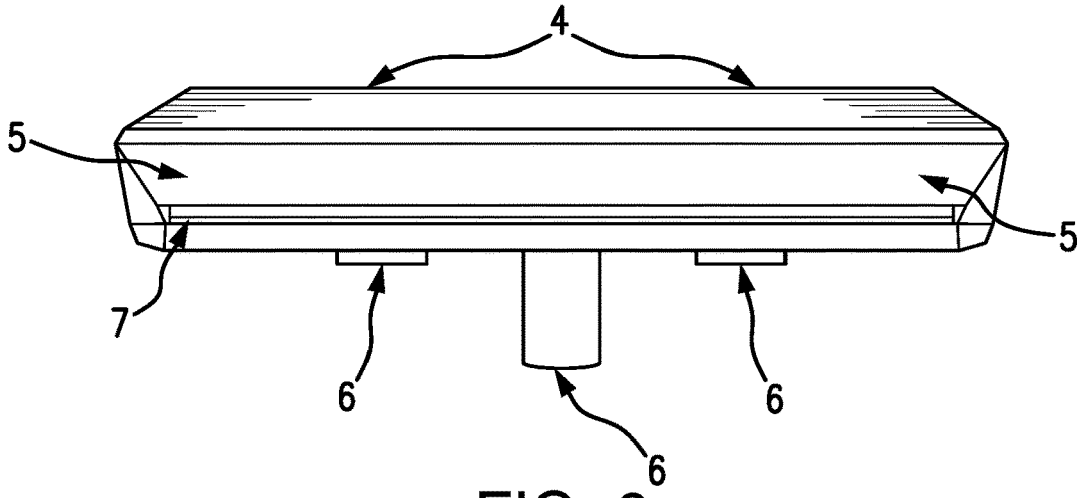
FIG. 6 is an illustration of the split safety razor of the present invention as it comes into contact with the user's face.

FIG. 3 illustrates the split halves of the standard double edge safety razor blade (7) according to the invention. FIG. 3 also illustrates slots (9) on either side of the bottom plate (5) into which the razor blade halves are inserted. When the top plate's cylinders (6) are inserted into the holes (8) of the bottom plate, the blade halves are bent to be locked in the slot at the correct optimum shaving angle. This feature is further shown in FIGS. 4 and 5.

The invention accomplishes this goal by a user breaking the razor blade (7) in half along the longer access of the razor head (3). The razor blade (7) is then inserted into a slot (9) into the bottom plate (5) of the razor head (3). The top plate (4) of the razor head (3) is then lowered so that it makes contact with the bottom plate by a standard mechanism in the safety razor (1) not shown here. The three cylinders (6)

move into the three holes (8) and hold the razor blade (7) in a tight position. Indeed, when the top plate (4) is tightened to the bottom plate (5), the largest portion of the razor blade (7) not in the slot (9) will bend resulting in a much lower profile head (3) and giving the user much more clearance than conventional safety razors currently on the market. This extra clearance makes it much easier to see and maintain proper blade angles while shaving under the nose and in other tight areas. Bending the largest portion makes the razor blade (7) even more secure and held at the desired angle because the portion of the razor blade (7) which is in the slot and (9) presses toward the top of the slot (9) due to the fact that the razor blade (7) is made from relatively stiff material such as steel or aluminum.

An alternative way of making slots in the razor head is to place structures on the top plate which are capable of producing a slot of 30°.

Another alternative way of making this razor is to stack two or more slots on either/each side of the bottom plate resulting in a "cartridge" type of razor. In this way, the razor is effectively the cartridge with only the blades being replaceable. This will result in the most inexpensive version of the present shaver.

Another alternative way of making this style razor is to incorporate my split and slotted design with others currently on the market such as closed comb, open comb, straight bar and slanted razors with either mild blade gaps, aggressive blade gaps or gaps anywhere in between.

As noted, the slot (9) holds the razor blade (7) at a 30° angle measured from the outside portion of the razor head (3) and the user's face.

One of the features of this invention is to provide a new shaver that will cut facial hair efficiently so that no further shaving is necessary for a period of 24 hours.

Another feature of this invention is to provide a new shaver that will reduce nicks and cuts, as well as abrasions, during the shaving process.

Another feature of the invention is to provide a new shaver that will keep the blade edge at 30° while enabling the handle to remain parallel to the skin while shaving.

Another feature of the invention is to provide a new shaver that will bend the large part of the blade that is not in the slot to gain much improved head (3) clearance.

Another feature of the invention is to provide a new shaver that facilitates receipt of a split blade design. By splitting the blades, it enables the top (4) and bottom (5) plates to be widened allowing better handle clearance when holding the handle parallel to the face and an overall thinner head (3) to get into tighter spots such as under the nose. And as noted herein, the head can be configured to hold only one of the blades or two of the split blades. When configured to hold one split blade, the razor can be a single edge safety razor or a single edge plastic disposable razor.

Another feature of this invention is to enable the use of a wider bottom plate (4) due to the split razor configuration of this shaving device, providing additional clearance space between the shaving handle (2), razor (1), and user's face.

Another feature of the invention is that this shaver design holds the blades very tight against the bottom plate resulting in no blade flutter. Current conventional safety razors hold their blades securely but without much tension on the cutting portion of the blade.

The structure of the present split razor blade and handle easily achieves these and provides greater and easier manipulation of the handle and head during use to provide optimum cutting of facial hair by the user. For this, a preferred construction of the safety razor is achieved using metal heads and handles. These provide the desired feel of a heavy, sturdy razor that can be used with minimal effort while the weight of the device contributes to a smooth shave.

Therefore, in sum, it is to be realized that the optimum dimensional relationships for the parts of the invention to include variations in size, materials, shape, form, function and use are deemed readily apparent and obvious to the skilled artisan, and all equivalent relationships to those illustrated in the drawings and described in the specification are intended to be encompassed by the present invention. For example, the handle and head can be designed to hold only one-half of the blade and thus would be configured with only one side available for cutting. In this regard, the handle and head could be made of metal as described herein or if desired, could be made of plastic so that the shaver could be disposable.

Thus, the foregoing is considered as illustrative only of the principles of the invention. Further, since numerous modifications and changes will readily be apparent to those having ordinary skill in the art, it is not desired to limit the invention to the exact construction demonstrated. Accordingly, all suitable modifications and equivalents may be resorted to falling within the scope of the invention. Unless defined otherwise, all technical and scientific terms used herein have same meaning as commonly understood by one of ordinary skill in the art to which this invention belongs.

As used herein and in the appended claims, the singular form "a", "and", and "the" include plural referents unless the context clearly dictates otherwise. All technical and scientific terms used herein have the same meaning.

The publications discussed herein are provided solely for their disclosure prior to the filing date of the present application. All publications, patent applications, patents are incorporated by reference in their entirety. Nothing herein is to be construed as an admission that the present invention is not entitled to be of patentable nature.

What is claimed is:

1. A safety razor comprising: a handle; a head on one end of the handle, said head mounted to the handle and adapted to hold a razor blade and having a top plate and a bottom plate; and a slot configured on the bottom plate, with the slot configured and dimensioned for receiving a first portion of the razor blade which terminates at a blade edge and for holding the blade edge under tension at a single, fixed, predetermined angle with respect to the bottom plate; wherein the top plate of the head is further configured to hold the blade in the slot to lock the blade in place with the blade edge at the predetermined angle, wherein the bottom plate has a bottom surface opposite the top plate, and the handle is vertically mounted to the bottom surface of the bottom plate.

2. The safety razor of claim 1, wherein the predetermined ale is a first predetermined angle; wherein the slot is a first slot configured on a first portion of the bottom plate, the head further comprises a second slot configured on a second portion of the bottom plate, and the second slot configured and dimensioned for receiving a second portion of the razor blade which terminates as a second at a second predetermined angle with respect to the bottom plate; and wherein when the first portion of the razor blade is placed in the first slot and the second portion of the razor blade is placed in the second slot, the top plate of the head is capable of being lowered to come into contact with the bottom plate to lock the first portion of the razor blade in the first slot with the blade edge thereof at the first predetermined angle and the second portion of the razor blade in the second slot with the second edge thereof at the second predetermined angle.

3. The safety razor of claim 2, wherein, when the top plate of the head is lowered to come into contact with the bottom plate, a part of each of the first portion of the razor blade and the second portion of the razor blade opposite each of their respective blade edges is bent to lock the first portion of the razor blade and the second portion of the razor blade in place in the first slot and the second slot respectively.

4. The safety razor of claim 2, wherein the head further comprises two structures which move downwardly toward the intersection of the head and the handle; said structures designed to bend and hold each portion of the razor blade under tension in its respective slot.

5. The safety razor of claim 2, wherein the first portion of the razor blade and the second portion, of the razor blade are respectively a first half and a second half of the razor blade which together form a double edge safety razor blade.

6. The safety razor of claim 5, wherein the head further comprises two structures which move downwardly toward the intersection of the head and the handle; said structures designed to securely hold the first half and the second half into the first slot and the second slot respectively.

7. A method of making a safety razor with two fixed blade edges at a predetermined cutting angle, which comprises: providing a handle and a head for the safety razor; making a slot on each side of a bottom plate of the head, with each slot configured and dimensioned to receive a portion of a razor blade and for holding each blade edge under tension and with each blade edge fixed at the predetermined angle, and providing the head with two structure which move downwardly toward the intersection of the head and the handle; wherein said structures are designed to bend each of a first half of the razor blade and a second half of the razor blade to hold the portion of the razor blade in its respective slot and to have the two fixed blade edges at the predetermined cutting angle.

* * * * *